United States Patent [19]

Constant et al.

[11] Patent Number: 4,814,022

[45] Date of Patent: Mar. 21, 1989

[54] WELDABLE ALUMINUM ALLOY WORKABLE INTO SHEET FORM AND PROCESS FOR ITS PRODUCTION

[75] Inventors: Didier Constant, St Egreve; Gilbert Gutmann, Algoshein, both of France

[73] Assignee: Cegedur Societe de Transformation de l'Aluminum Pechiney, Paris, France

[21] Appl. No.: 68,118

[22] Filed: Jun. 30, 1987

[30] Foreign Application Priority Data

Jul. 7, 1986 [FR] France ..... 86 10028

[51] Int. Cl.[4] ..... C22F 1/04

[52] U.S. Cl. ..... 148/2; 148/12.7 A; 148/439

[58] Field of Search ..... 420/534; 148/11.5 A, 148/127 A, 439, 440, 2

[56] References Cited

U.S. PATENT DOCUMENTS 4,082,578 4/1978 Evancho et al. ..... 148/12.7 A
4,174,232 12/1977 Lenz et al. ..... 148/11.5 A

FOREIGN PATENT DOCUMENTS 2446865 1/1979 France .

*Primary Examiner*—R. Dean
*Attorney, Agent, or Firm*—Oblon, Fisher, Spivak, McClelland & Maier

[57] ABSTRACT

A weldable aluminum alloy workable into sheet form containing Si, Mg and Cu, and a process for its production are disclosed.

The alloy comprises (in percent by weight) proportions of Si and Mg as defined by a trapezium having the following co-ordinates:

| | Si | Mg |
|---|---|---|
| (A) | 0.5 | 0.1 |
| (B) | 0.5 | 0.2 |
| (C) | 1.3 | 0.5 |
| (D) | 1.3 | 0.1 |

Cu: 0.1–0.5;
Mn: 0–0.2;
Ti: 0–0.1;
Fe: 0–0.35;
other impurites each: ≦0.05
total impurity content: ≦0.15
balance Al.

The production procedure comprises semi-continuous or continuous casting of blanks, an optional homogenisation operation, a hot transformation operation which is terminated in the range of 270° to 340° C., an optional cold transformation operation, a complete solution treatment, a shaping operation using stamping or pressing, folding, bending, etc . . . , and a tempering operation.

20 Claims, 1 Drawing Sheet

WELDABLE ALUMINUM ALLOY WORKABLE INTO SHEET FORM AND PROCESS FOR ITS PRODUCTION

BACKGROUND OF THE INVENTION

1. Field of the Invention

The invention relates to weldable aluminum alloys which can be worked into sheet form, and to processes for their production.

2. Discussion of the Background

The series 6000 alloys, as defined by the Aluminum Association nomenclature, were essentially developed in the form of shaped members, although some of those alloys such as 6061 or 6082 are generally produced in the form of plates or strips intended for stamping or pressing. Conventional series 6000 alloys are charged with magnesium to a level not far away from stoichiometry with respect to $Mg_2Si$.

Alloys which are included in the series 6000 family are described in French patent Nos. FR-A No. 2 375 332 and FR-A No. 2 360 684, corresponding to U.S. Pat. Nos. 4,174,232 and 4,082,578, respectively. Those alloys, while being less highly charged with magnesium than conventional alloys of the series 6000, have a much higher silicon content.

Patent application FR No. 2 375 332 describes a process in which a Si-rich alloy is treated in such a way as to produce a fine submicronic precipitation of Si (having a particle size of 0.1 to 0.5 μm) under a condition of supersaturation. This size is intermediate between the eutectic phases present in the alloy and the hardening phases which are usually found in Al-Si-Mg-Cu alloys.

Although the above-indicated precipitation of Si is reported to afford a certain number of advantages, it also provides some disadvantages. Excessive silicon precipitates reduce the levels of capacity for shaping of the material. In addition, the presence of these silicon precipitates weakens the resistance of the alloy to corrosion under use.

French patent application No. 2 360 684 describes an Al-Si-Mg-Cu alloy containing at least one recrystallisation inhibitor element selected from the group Mn, Cr and Zr. However, the presence of these elements is not advantageous. Mn in particular involves a number of disadvantages:

Mn gives rise to solidification of the intermetallic compounds based on Fe, Mn and Si. These reduce the capacity for shaping of the alloy and can initiate a decohesion and rupture phenomena when shaping operations are carried out.

Mn increases the critical quenching speed and therefore limits options in heat treatments of thick products.

Mn imparts to the alloy a poor level of performance in regard to corrosion resistance.

And Mn is not suited to short-duration homogenization operations such as those which are generally carried out in tunnel furnaces.

The incorporation of Cr or Zr results in effects similar to those produced by Mn.

The problem with which one skilled in this art is faced is therefore the problem of producing a weldable Al-Si-Mg-Cu alloy which can be stamped or pressed, which does not suffer from the above-indicated disadvantages, and which has satisfactory mechanical properties in the hardened state. The Al-Si-Mg-Cu alloy must additionally possess good suitability for cold shaping in the quenched state, and good resistance to corrosion, as a result of a simple heat treatment which excludes the presence of any precipitation of submicronic phase essentially consisting of Si.

The art has not yet found a solution to these problems. There is therefore a strongly felt need for a weldable Al-Si-Mg-Cu alloy which does not suffer from the above disadvantages.

SUMMARY OF THE INVENTION

Accordingly, it is an object of this invention to provide a high quality weldable aluminum alloy.

It is another object of this invention to produce a high quality weldable Al-Si-Mg-Cu alloy.

It is another object of this invention to provide a weldable aluminum alloy which can be worked in sheet form.

The present inventors have now discovered such an aluminum alloy. They have discovered a weldable aluminum alloy which satisfies all of the above objects of this invention, and other objects which will become apparent from the description of the invention given herein below.

This weldable aluminum alloy can be worked in sheet form. It is characterized by containing the following proportions of Si and Mg, in percent by weight, which are delimited by a trapezoid ABDC having the following co-ordinates:

| | Si | Mg |
|---|---|---|
| (A) | 0.5 | 0.1 |
| (B) | 0.5 | 0.2 |
| (C) | 1.3 | 0.5 |
| (D) | 1.3 | 0.1 |

This relationship between Si and Mg is graphically presented in FIG. 1.

The aluminum alloy also contains Cu in an amount of 0.1 to 0.5% by wt., manganese in an amount of from 0 to 0.2% by wt., and iron in an amount of from 0 to 0.35% by wt. Impurities can be present in an amount of up to 0.05% by wt., with a total content of impurities of no more than 0.15% by wt. The balance of this weldable aluminum alloy is aluminum.

BRIEF DESCRIPTION OF THE FIGURES

A more complete appreciation of the invention and many of intended advantages will be readily obtained as the same becomes better understood by reference of the following detailed description when considered in connection with the accompanying FIGURES, wherein.

DETAILED DESCRIPTION OF THE PREFERRED EMBODIMENTS

Figure 1:
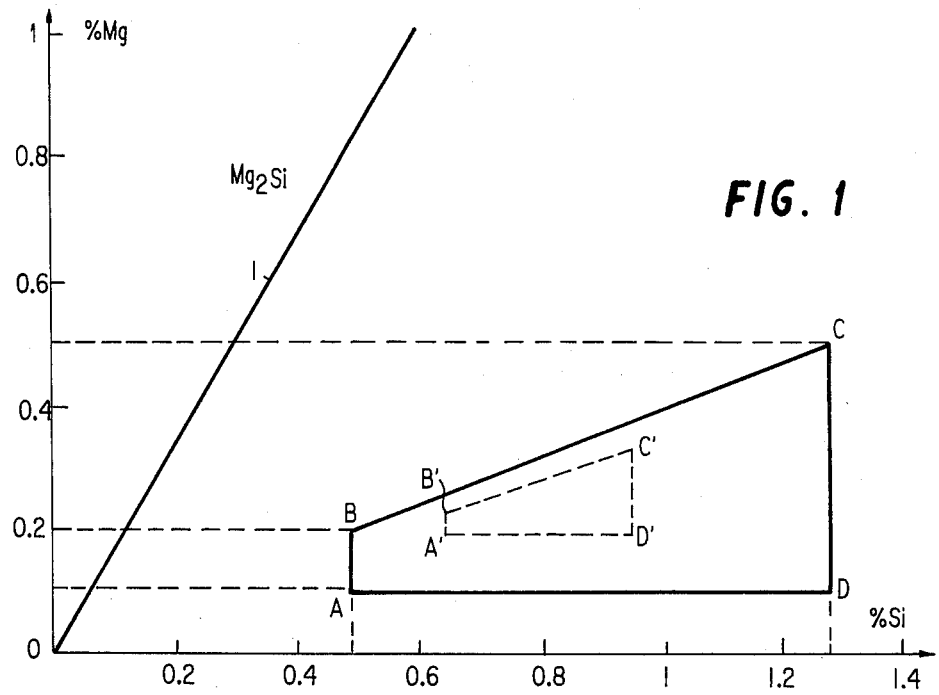
FIG. 1 illustrates the relationship between the amount of silicon and magnesium used in the alloy of the present invention.

In accordance with the invention the alloy comprises (in percent by weight) proportions of Si and Mg which are defined by a trapezium having the following coordinates:

| | Si | Mg |
|---|---|---|
| (A) | 0.5 | 0.1 |
| (B) | 0.5 | 0.2 |

-continued

| | Si | Mg |
|---|---|---|
| (C) | 1.3 | 0.5 |
| (D) | 1.3 | 0.1 |

The alloy also contains copper, manganese, titanium and iron in the following % by weight ranges:
Cu: 0.1–0.5;
Mn: 0–0.2;
Ti: 0–0.1;
Fe: 0–0.35;
other impurities, each≦0.5% by weight;
total impurities≦0.15% by weight; and
the balance is aluminum.

Below the minimum values given above for the main elements (Si, Mg and Cu), the desired mechanical characteristics in the treated state are not attained. With Si≧1.3%, the heat treatment for producing a complete solution effect is difficult to carry out on an industrial scale, as will be demonstrated hereinafter. With Mg≧0.5%, problems occur in hot transformation (a fragilisation effect occurs) and the suitability for stamping or pressing is reduced.

It may also be observed that the minimum Si/Mg ratio (the side BC of the trapezium of FIG. 1) remains equal to or higher than 2.6 approximately. This limits the maximum degree the precipitation of $Mg_2Si$ in the course of solidification. Thus, the fine $Mg_2Si$ precipitations which occur in the alloy result only from the heat treatments to which it is subjected.

With Cu≧0.58%, resistance to corrosion is reduced and suitability for stamping or pressing is improved.

The secondary elements are limited for the following reasons:

As explained above, the presence of Mn is not desirable. However, Mn is accepted, up to a maximum level of 0.2%. This level of Mn results from possible contamination effects involving that element due to the recycling of waste materials.

It should be noted that the alloy does not comprise any intentional additions of Cr and/or Zr.

As is known, Ti in association with B controls the degree of fineness of the primary crystallisation of rough cast products (plates, strips, billets etc. . . .) and permits shorter homogenisation and solution treatment operations, in particular in the treatment of flat products (plates and strips). The effective proportions are Ti≦0.1% by weight and B≦0.05% by weight. The Fe content is limited to 0.35% in order to avoid the formation of coarse primary compounds containing Fe (of the type Al-Mn-Fe-Si).

A preferred composition of the alloy according to the invention (in percent by weight) is as follows, with proportions of Si and Mg contained a trapezium having the following apices:

| | Si | Mg |
|---|---|---|
| (A') | 0.65 | 0.2 |
| (B') | 0.65 | 0.18 |
| (C') | 0.95 | 0.28 |
| (D') | 0.95 | 0.2 |

The other elements are present in the following percent by weight:
Cu=0.10–0.25
Mn=0–0.15
Ti=0–0.1
Fe=0–0.3
other impurities, each≦0.05
total impurities≦0.15
balance Al.

The procedure for producing the alloys according to the invention generally comprises continuous or semi-continuous casting of blanks, an optional homogenisation treatment, a hot transformation operation, an optional cold transformation operation, a solution treatment, and tempering. However, in order to give the alloy good properties and in particular a level of grain fineness of lower than 80 μm on average, those operations have to be carried out under fairly narrow conditions.

Thus, in order to limit the time for subsequent solution treatment, it is preferable for the alloy to be well homogenised, while avoiding burning it, by fusion of the eutectic phases. Homogenisation at a high temperature of between 550° C. and 570° C. with a hold time of 6 to 24 hours is desirable. The homogenisation operation is preferably preceded by a slow rise in temperature.

Hot transformation is effected by use of any known method (rolling, extrusion, forging, etc. . . .). However, that operation must then be carried out in such a way as to avoid a coarse recrystallisation phenomena in the course of operation.

In the case of plates and strips, the coarse hot recrystallisation phenomena is the source of macroscopic deformation lines which are visible after stamping or pressing and which are therefore prohibitive in regard to this use. Accordingly it is imperative for the final hot transformation temperature to be between 270° and 340° C., in order to avoid such recrystallisation phenomena.

After the optional cold transformation operation, the alloy is subjected to complete solution treatment. That operation takes place in the temperature range of between 540° and 580° C., preferably between 550° and 570° C., aiming at a temperature of about 560° C.

Having regard to the deliberate absence of recrystallisation inhibitor elements (Mn, Cr and Zr), the rise in temperature before the solution treatment takes effect must be fast (V≧10° C./ second). And the solution treatment operation is preferably carried out either in a tunnel furnace or in a furnace for treating the material from one plate to another.

The treatment time varies from a few seconds to a few minutes, without exceeding 1 hour. The plates and strips which are produced in that way afford good isotropy and a mean grain size which does does not exceed 60 μm.

The quenching operation must be fast and depends on the thickness of the product. For sheets and strips, it is generally carried out in calm air or in a forced air flow.

After the cold shaping operations such as stamping or pressing, folding, bending etc. and/or assembly operations such as welding, the parts are subjected to a hardening tempering treatment under the usual conditions. Hardening is due to the precipitation of the phase $Mg_2Si$ and complex phases Al-Cu-Mg and Al-Cu-Mg-Si. The tempering operation is typically carried out at 160° to 170° C., preferably about 165° C. for from 8 to 12 hours.

It should be noted that in certain cases, the operation of firing or baking surface coatings such as varnishes ipso facto produces that treatment, although the firing or baking operation is a shorter one.

Figure 2:
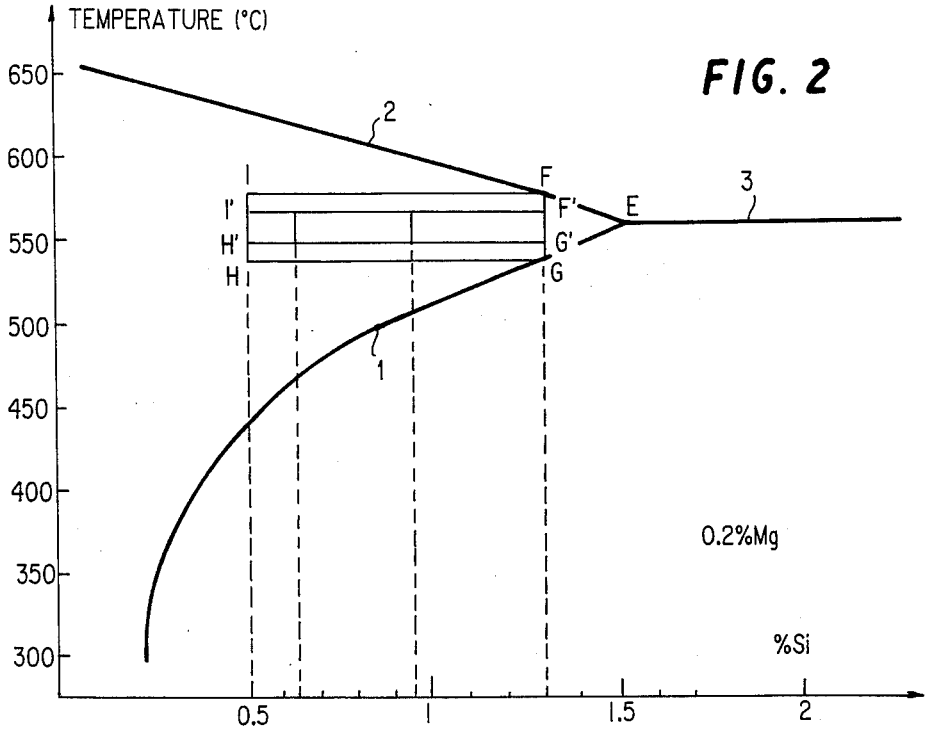
FIG. 2 illustrates the range for solution treatment or homogenization for an alloy of the invention.

The invention will be better appreciate by reference to the following Examples illustrated in the figures wherein like reference numerals and letters designate identical or corresponding parts. FIG. 1 shows the range in respect of composition of the elements Si and Mg of the alloy. FIG. 2 shows the range for solution treatment or homogenisation of an alloy according to the invention, in a vertical section of the constitutional diagram of Al, Mg and Si with 0.2% Mg.

Referring to FIG. 2, reference numeral 1 denotes the solvus curve. Reference numeral 2 denotes the solidus curve. Reference numeral 3 denotes the eutectic level. These meet at a point E.

The solution treatment (or homogenisation) has to be carried out in the single-phase range and in particular under the conditions in respect of temperature represented by the rectangle FGHI for the general range and F'G'H'I' for the preferred range.

It will be apparent from those curves that, with high proportions of Si, the treatment involved is a delicate operation since a small variation relative to the reference temperature results either in precipitation of Si if the temperature drops or 'burning' of the metal if the temperature rises. That heat treatment therefore requires a precise industrial installation.

The alloys of this invention have the following advantages:

The alloy is supplied in the state T4 to the operators who are to transform it.

In that state, the alloy is ductile and lends itself well to deformation. Aging at ambient temperature is very slight.

The cold-deformed component acquires better strength characteristics by cold working, at least locally in the most highly deformed zones. The softening effect due to reheating in the welding operation is partially compensated by the structural hardening effect in the final tempering operation (T6).

To attain the most ductile state, after quenching the metal is only subjected to the finishing operations that are strictly necessary (such as straightening, planing, etc. . . .).

Other features of the invention will become apparent in the course of the following descriptions of exemplary embodiments which are given for illustration of the invention and are not intended to be limiting thereof.

EXAMPLE 1

A plate measuring 1500×400 mm$^2$ and having the following composition (in % by weight): Si 0.90; Mg 0.30; Cu 0.20; Fe 0.25; and Ti 0.03, was cast using a conventional semi-continuous casting process. The plate was homogenised for 10 hours at a temperature of 555° C. (scalped to 1500×420 mm$^2$) and then hot rolled to a thickness of 4 mm with finishing at between 320° and 300° C. The coils produced in that way were cold rolled to a thickness of 1.25 mm.

The solution treatment thereof was effected in a tunnel furnace at a speed of 20 meters per minute, with hold time at a temperature of 560° C. of the order of 1 minute and a rate of temperature rise of the order of 25° C./second.

The mechanical characteristics as measured in the direction of the rolling operation, in a transverse direction and in a direction at 45° to the direction of the rolling operation, are set forth in the following Table:

| | Direction | | |
|---|---|---|---|
| MC | Long | 45° | Transverse |
| Rm (MPa) | 235 | 233 | 232 |
| Rp 0.2 (MPa) | 110 | 109 | 108 |
| E % | 25 | 29 | 27 |

The above measurements show that the product obtained is relatively homogenous and isotropic.

Anisotropy was estimated by producing bowls and measuring the proportion of corners or ears configurations in accordance with the standard AFNOR NF-A-50-301. That value found was 7%. The grain size as measured by metallography was 40 μm.

Plates cut from the solution-treated metal were finished off by shaping as parts of motor vehicle bodywork, in this case a front hood.

After stamping or pressing, it was covered with a protective coating (paint) before being subjected to a baking operation for 1.5 hours at 180° C.

The mechanical characteristics produced as a function of the degree of local cold working are as follows:

| Rate of cold working (%) | Rp 0.2 (MPa) | Rm (MPa) | E % |
|---|---|---|---|
| 0 | 225 | 285 | 15 |
| 5 | 250 | 290 | 10 |
| 10 | 265 | 295 | 8 |

EXAMPLE 2

A sheet of the same composition as that set forth in Example 1 was welded to another sheet of the same composition by spot welding under the following conditions.

An electrode of 'Mallory 328' of frustoconical shape with an angle of 60° at the apex and an insert diameter ϕ of 5.5 mm was used.

Bearing force: 400 kg strength: 27000 A frequency: 2 Hz.

The assembly was then raised to a temperature of 165° C. in an oven for a period of 10 hours. The shearing strength of the welded joints produced in that way was on the order of 280 MPa. The good properties obtained after welding and tempering should be noted.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A weldable aluminum alloy workable in sheet form, consisting essentially of:

(i) silicon and mangesium in a % by weight proportion delimited by a trapezium ABCD having the coordinates:

| | Si | Mg |
|---|---|---|
| (A) | 0.5 | 0.1 |
| (B) | 0.5 | 0.2 |
| (C) | 1.3 | 0.5 |

-continued

| | Si | Mg |
|---|---|---|
| (D) | 1.3 | 0.1 |

(ii) copper in an amount of from 0.1 to 0.5% by weight; and (iii) manganese in an amount of less than 0.2% by weight, wherein the balance of said alloy is aluminum and incidental impurities and said alloy is characterized by the substantial absence of a precipitated submicronic phase consisting essentially of silicon.

2. The weldable aluminum alloy of claim 1, further consisting essentially of titanium in an amount of from 0 to 0.1% by weight.

3. A weldable aluminum alloy workable in sheet form, consisting essentially of:

(i) silicon and magnesium in a % by weight proportion delimited by a trapezium A'B'C'D' having the coordinates:

| | Si | Mg |
|---|---|---|
| (A') | 0.65 | 0.2 |
| (B') | 0.65 | 0.18 |
| (C') | 0.95 | 0.28 |
| (D') | 0.95 | 0.2 |

(ii) copper in an amount of from 0.1 to 0.25% by weight; and (iii) manganese in an amount of less than 0.15% by weight, wherein the balance of said alloy is aluminum and incidental impurities and said alloy is characterized by the substantial absence of a precipitated submicronic phase consisting essentially of silicon.

4. The weldable aluminum alloy of claim 3, further consisting essentially of titanium in an amount of from 0 to 0.1% by weight.

5. The weldable aluminum alloy of claim 3, further consisting essentially of iron in an amount of from 0 to 0.3% by weight.

6. A process for producing a weldable aluminum alloy workable in sheet form, consisting essentially of:

(i) silicon and magnesium in a % by weight proportion delimited by a trapezium ABCD having the coordinates:

| | Si | Mg |
|---|---|---|
| (A) | 0.5 | 0.1 |
| (B) | 0.5 | 0.2 |
| (C) | 1.3 | 0.5 |

-continued

| | Si | Mg |
|---|---|---|
| (D) | 1.3 | 0.1 |

(ii) copper in an amount of from 0.1 to 0.5% by weight; and (iii) manganese in an amount of less than 0.2% by weight, wherein the balance of said alloy is aluminum and incidental impurities and said alloy is characterized by the substantial absence of a precipitated submicronic phase consisting essentially of silicon, said process comprising the steps of:

(i) casting a blank of said weldable aluminum alloy;

(ii) subjecting said blank to a hot transformation operation in the temperature range of from 270° to 340° C., a solution treatment in the temperature range of from 540°-580° C., a quenching operation, a shaping operation to give an untempered alloy; and (iii) tempering said untempered alloy to obtain said alloy.

7. The process of claim 6, further comprising the step of subjecting said blank to a homogenization operation in the temperature range of from 540°-580° C. before said subjecting to hot transformation step.

8. The weldable aluminum alloy of claim 1, containing iron in an amount of from 0 to 0.35% by weight.

9. The weldable aluminum alloy of claim 1, containing impurities, each in an amount of not more than 0.05% by weight.

10. The weldable aluminum alloy of claim 1, wherein the total amount of impurities is not more tahn 0.15% by weight.

11. The weldable aluminum alloy of claim 1, having a mean grain size less than 80 μm.

12. The weldable aluminum alloy of claim 3, having a mean grain size smaller than 80 μm.

13. The weldable aluminum alloy of claim 1, having a mean grain size smaller than 60 μm.

14. The weldable aluminum alloy of claim 3, having a mean grain size smaller than 60 μm.

15. The process of claim 6, comprising continuously casting a blank.

16. The process of claim 6, comprising semi-continuously casting a blank.

17. The process of claim 6, wherein said shaping operation is a stamping operation, a pressing operation, a folding operation, or a bending operation.

18. The process of claim 7, wherein said homogenization or solution treatment operation is carried at a temperature of from 550° to 570° C.

19. The process of claim 7, wherein said solution treatment is preceded by a rise in temperature at a rate greater than 10 degrees per second.

20. The process of claim 18, wherein said solution treatment is preceded by a rise in temperature at a rate greater than 10 degrees per second.

* * * * *